US008245849B2

(12) United States Patent
Sung

(10) Patent No.: US 8,245,849 B2
(45) Date of Patent: Aug. 21, 2012

(54) ARTIFICIAL NAIL DISPLAY PACKAGE

(75) Inventor: Siyong Sung, Roslyn Heights, NY (US)

(73) Assignee: Kiss Nail Products, Inc., Port Washington, NY (US)

( * ) Notice: Subject to any disclaimer, the term of this patent is extended or adjusted under 35 U.S.C. 154(b) by 0 days.

(21) Appl. No.: 12/797,325

(22) Filed: Jun. 9, 2010

(65) Prior Publication Data

US 2011/0303575 A1 Dec. 15, 2011

(51) Int. Cl.
*B65D 83/04* (2006.01)

(52) U.S. Cl. ..... 206/535; 206/457; 206/499

(58) Field of Classification Search ..... 206/546, 206/457, 581, 499, 526, 535, 536, 822; 63/1.14, 63/19; 215/6
See application file for complete search history.

(56) References Cited

U.S. PATENT DOCUMENTS

| | | | | |
|---|---|---|---|---|
| 1,999,328 | A * | 4/1935 | Lessard | 132/315 |
| 2,575,770 | A * | 11/1951 | Roop | 206/514 |
| 3,362,530 | A * | 1/1968 | Johnson | 206/535 |
| D287,578 | S * | 1/1987 | Shay et al. | D11/157 |
| D307,196 | S * | 4/1990 | McClure | D28/79 |
| 5,816,408 | A * | 10/1998 | Indelicato | 206/581 |
| 6,036,018 | A * | 3/2000 | Harrold | 206/536 |
| D460,354 | S * | 7/2002 | Goldiner et al. | D9/626 |
| 6,997,321 | B2 * | 2/2006 | Young | 206/581 |
| 7,628,278 | B2 | 12/2009 | Coppola | |
| 2004/0045867 | A1 | 3/2004 | Appelbaum | |
| 2005/0000850 | A1 * | 1/2005 | Young | 206/581 |
| 2005/0006267 | A1 * | 1/2005 | Lam et al. | 206/457 |
| 2006/0157375 | A1 * | 7/2006 | DeJonge | 206/535 |
| 2007/0045148 | A1 * | 3/2007 | Saclier et al. | 206/535 |
| 2008/0060957 | A1 | 3/2008 | Ford et al. | |
| 2008/0073237 | A1 | 3/2008 | Jackson | |
| 2008/0237082 | A1 | 10/2008 | Gherdan et al. | |

FOREIGN PATENT DOCUMENTS

| | | | |
|---|---|---|---|
| DE | 42 06 244 | | 9/1993 |
| EP | 1523903 | A1 | 4/2005 |
| FR | 2620913 | A1 * | 3/1989 |
| GB | 1016015 | A | 1/1996 |

OTHER PUBLICATIONS

European Search Report, Mar. 4, 2011 (6pgs).

* cited by examiner

*Primary Examiner* — David Fidei
(74) *Attorney, Agent, or Firm* — The Farrell Law Firm, P.C.

(57) ABSTRACT

A display package is provided that informs the customer of the product contained therein as well as providing a functional and useful storage unit for artificial nails when not in use. The display package includes a cylindrical portion and a main body, including a cavity within the main body of the display package. A first portion and a second portion of the display package divide the main body and the cylindrical portion and are joined together to form the display package. The display package is preferably in the shape of a bottle of nail polish and contains one or more trays having indentations for holding items such as artificial nails.

7 Claims, 8 Drawing Sheets

ARTIFICIAL NAIL DISPLAY PACKAGE

BACKGROUND OF THE INVENTION

1. Field of the Invention

The present invention relates generally to a display package, and more particularly to a display package shaped as a nail polish bottle for displaying artificial nails.

2. Description of the Related Art

An industry has grown around pre-formed artificial nails to provide people with the appearance of well-manicured hands while offering the convenience of a disposable and easy to maintain product. Caring for and growing nails naturally can be both costly and time consuming; thus fashion-conscious customers often choose artificial nails.

Artificial nails are generally packaged in a generic-looking cardboard and/or plastic display package. Typically square or rectangle in shape, common displays for artificial nails do not inform the customer as to the items contained within and are simply a way for a product to be delivered to the consumer. In general, these display packages are functionally unsatisfactory in that they must be torn open and do not easily re-seal, if at all. The desired artificial nails are removed and any extras are often impossible to store in the torn package for later use. This is not a secure method of storage and a user may become frustrated by having loose artificial nails fall out of the display package, and which may easily become lost.

Additionally, such display packages do not offer much in the way of marketing appeal. A more effective display package would allow a customer, from a distance, to recognize the product contained therein. In a marketing sense, a rectangular or square shaped box is not very appealing for a fashionable person shopping for a fashionable item.

For example, in Coppola (U.S. Pat. No. 7,628,278), a packaging arrangement for artificial nails is described. The packaging of Coppola is intended to educate the customer as to the curvature of their nail and guide them in choosing the appropriate product. However, the packaging does not hold the artificial nails in a readily accessible and convenient way. Additionally, the shape of the packaging does not provide an instantaneous recognition by the customer of the product contained within.

Accordingly, in the field of artificial nails, a display package is needed that informs the customer of the product contained therein as well as providing a functional and useful storage unit for artificial nails when not in use.

SUMMARY OF THE INVENTION

The present invention has been made to address at least the above problems and/or disadvantages and to provide at least the advantages described below. Accordingly, an aspect of the present invention provides a display package for artificial nails generally shaped as a nail polish bottle.

According to one embodiment of the present invention, an artificial nail display package is in the shape of a package of nail polish. The display package includes a cylindrical portion at one end of the display package extending from a main body, the main body having a flat base at a second end of the display package opposite to the cylindrical portion. The main body further includes a front wall, a back wall, and side-walls that contour inwards to connect to the cylindrical portion at one end of the display package and meet at the opposite end at the flat portion.

The display package further includes an empty cavity within the main body of the display package wherein a first portion and a second portion of the display package divide the main body and the cylindrical portion and may be affixed together to form the display package.

According to an additional embodiment of the present invention, the display package further includes one or more trays located within the empty cavity having a plurality of indentations for holding items, such as artificial nails. The plurality of indentations may be aligned in a grid pattern or various other patterns and shaped such that when a first tray is stacked on a second tray, the first and the second tray interlock. Additionally, the trays may be substantially the same shape as the main body.

BRIEF DESCRIPTIONS OF THE DRAWINGS

The above and other aspects, features and advantages of the present invention will be more apparent from the following description when taken in conjunction with the accompanying drawings, in which.

Figure 3A:
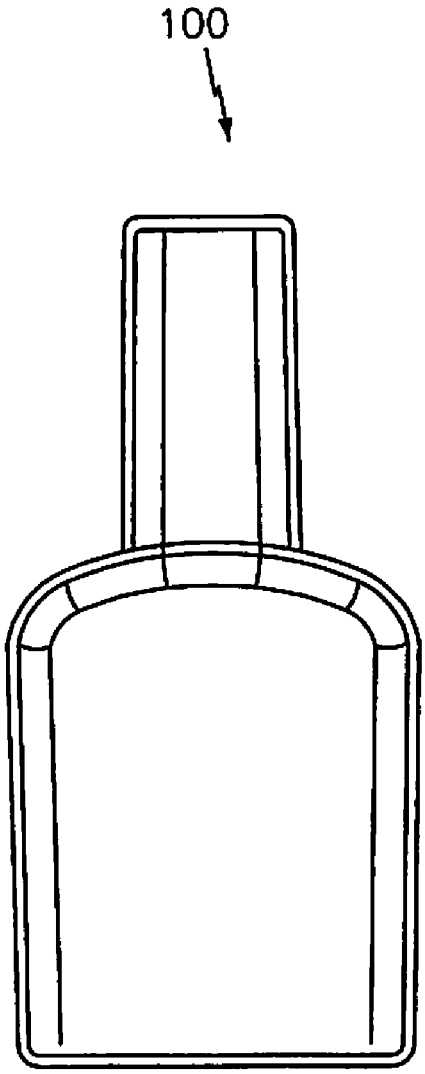
Figure 3B:
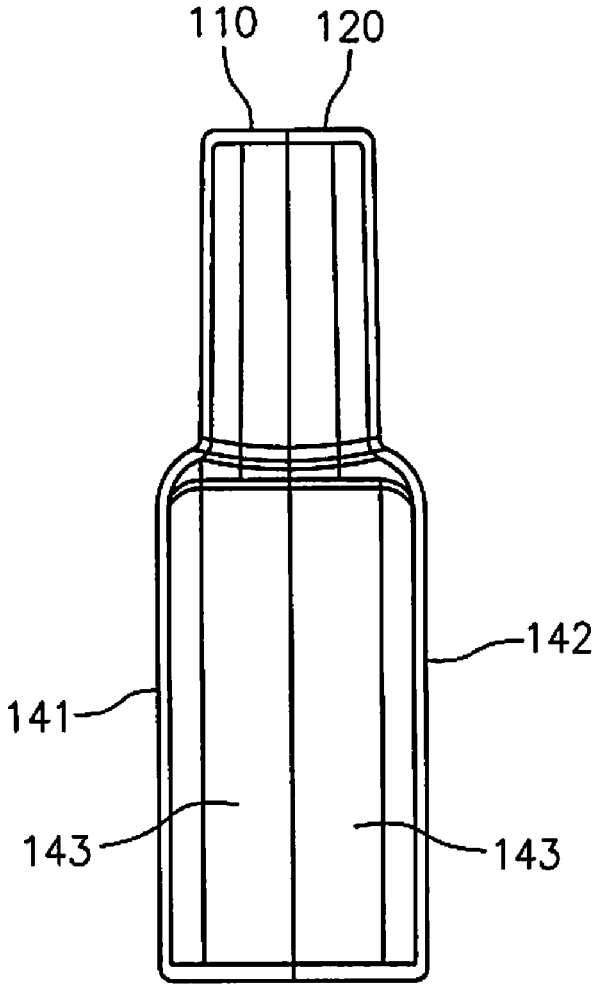
Figure 4:
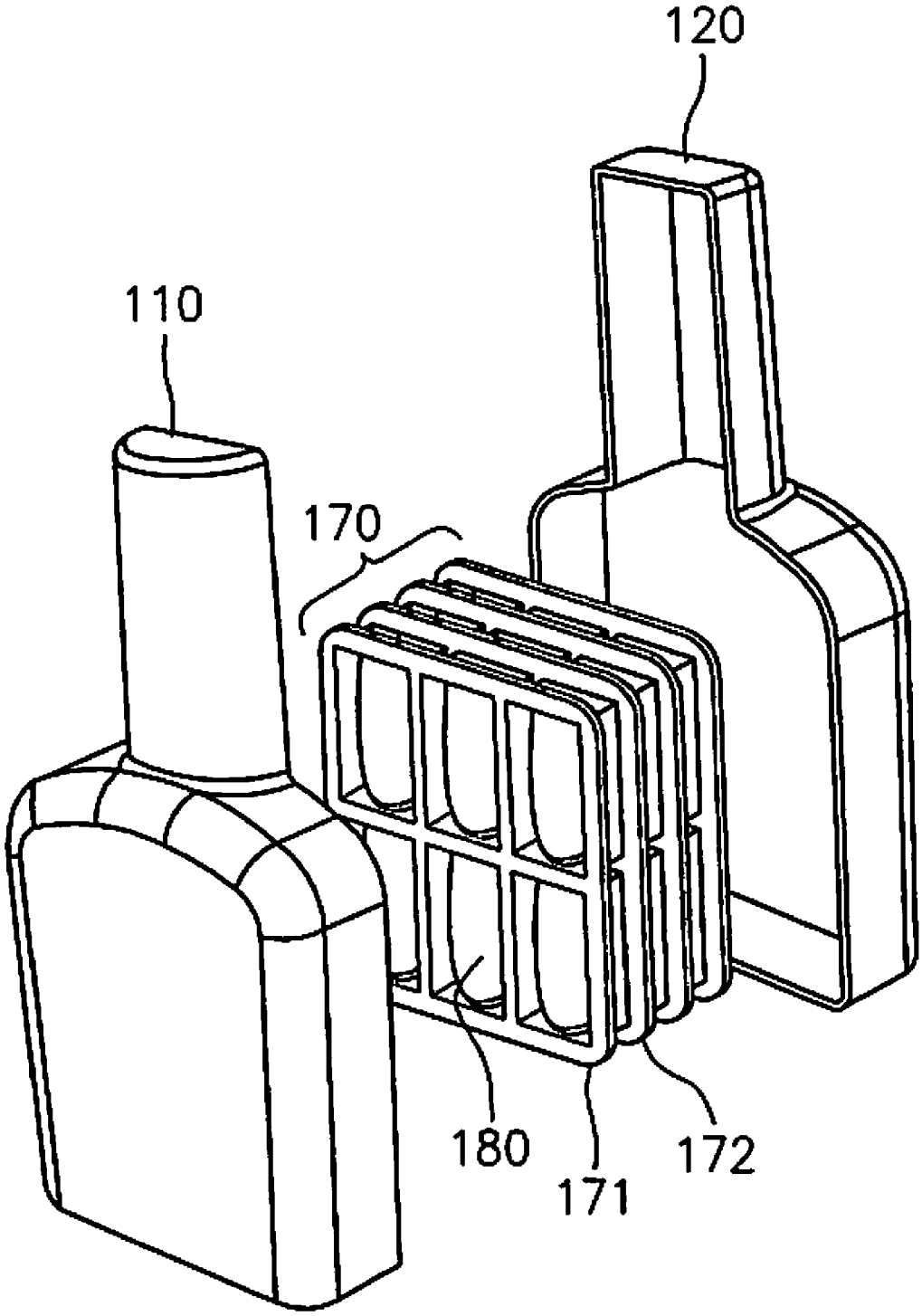
Figure 5A:
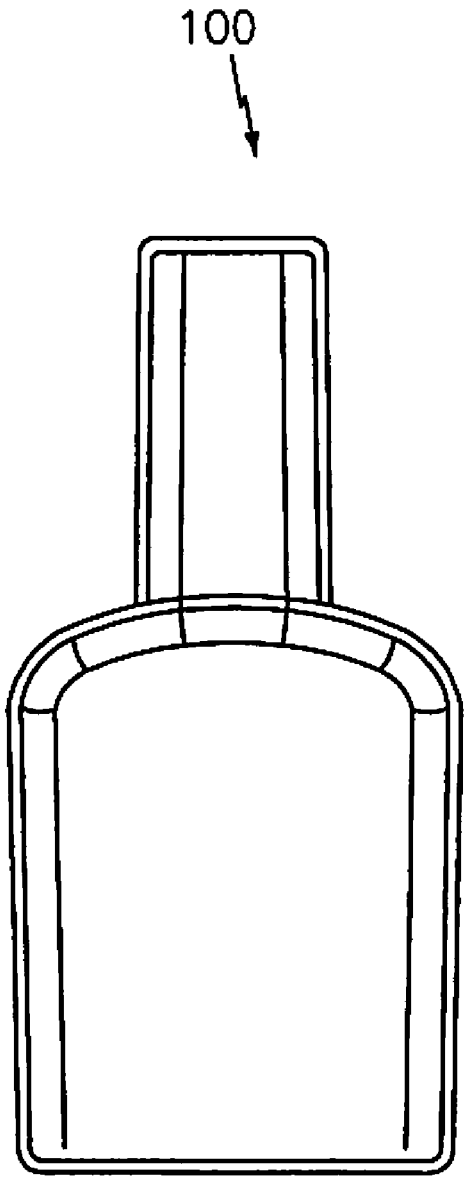
Figure 5B:
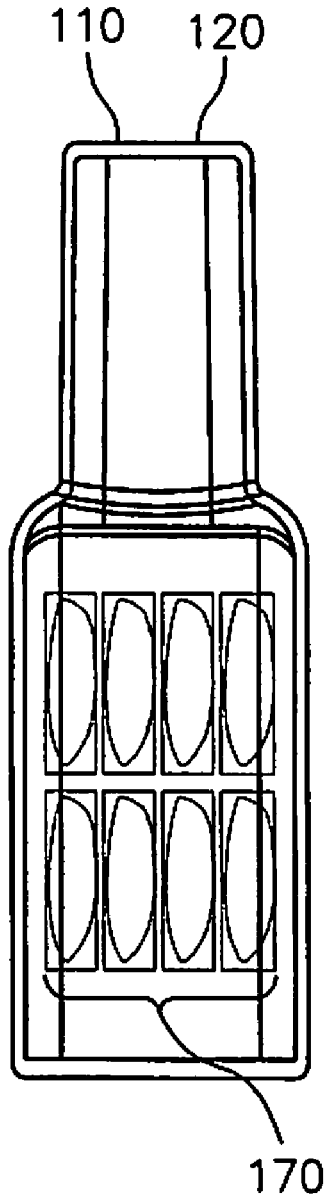
Figure 6:
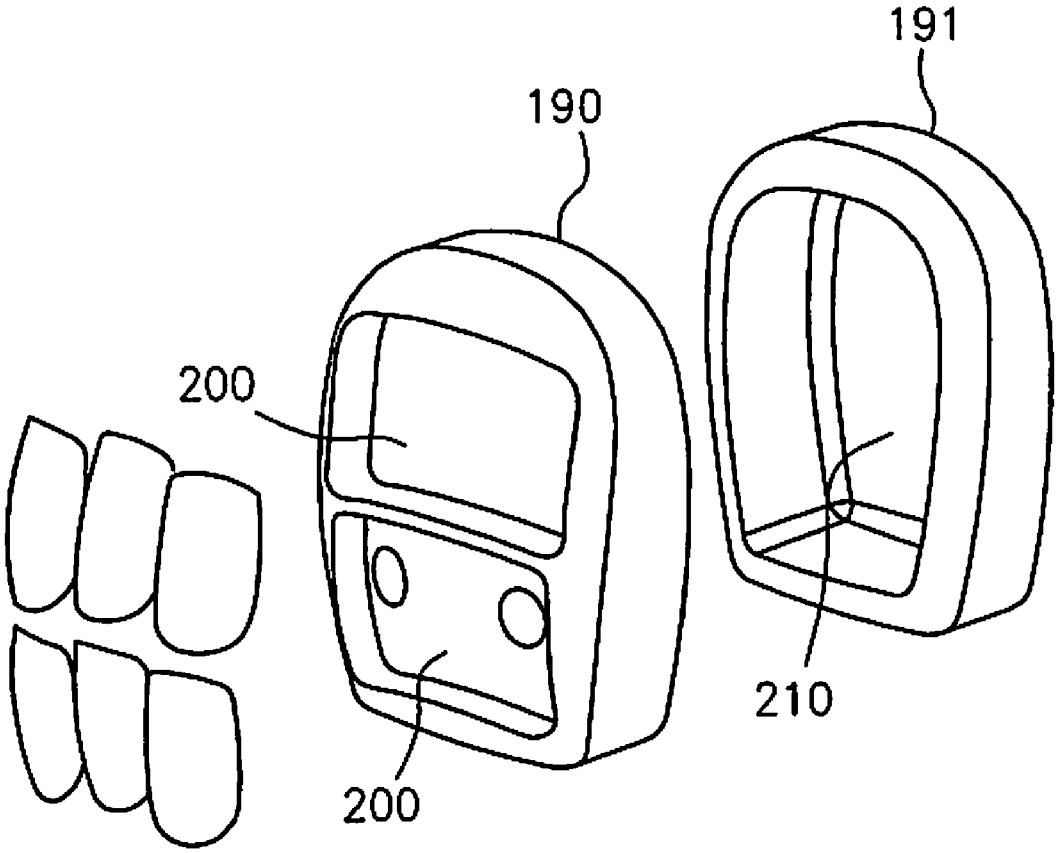
Figure 7:
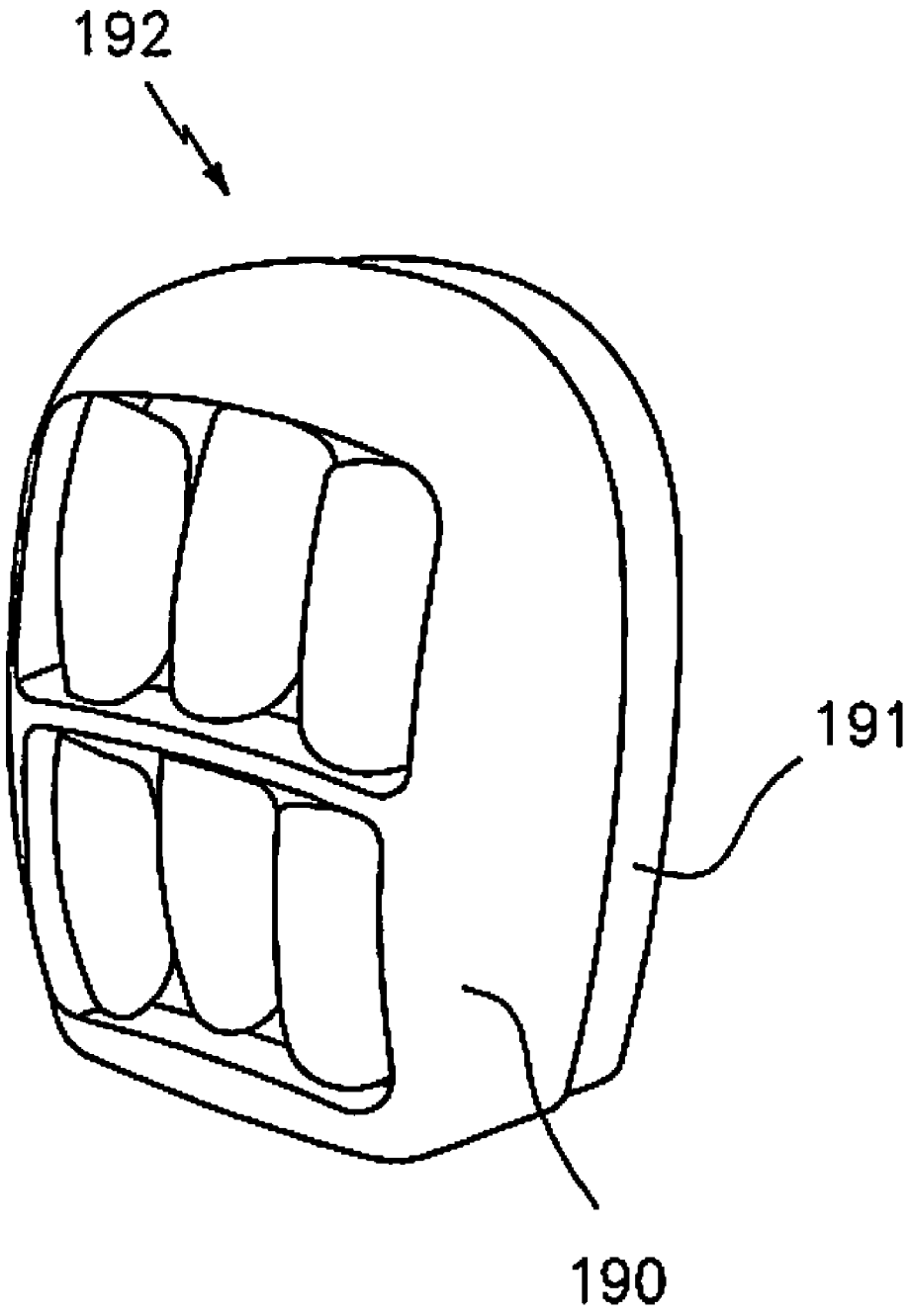
Figure 8:
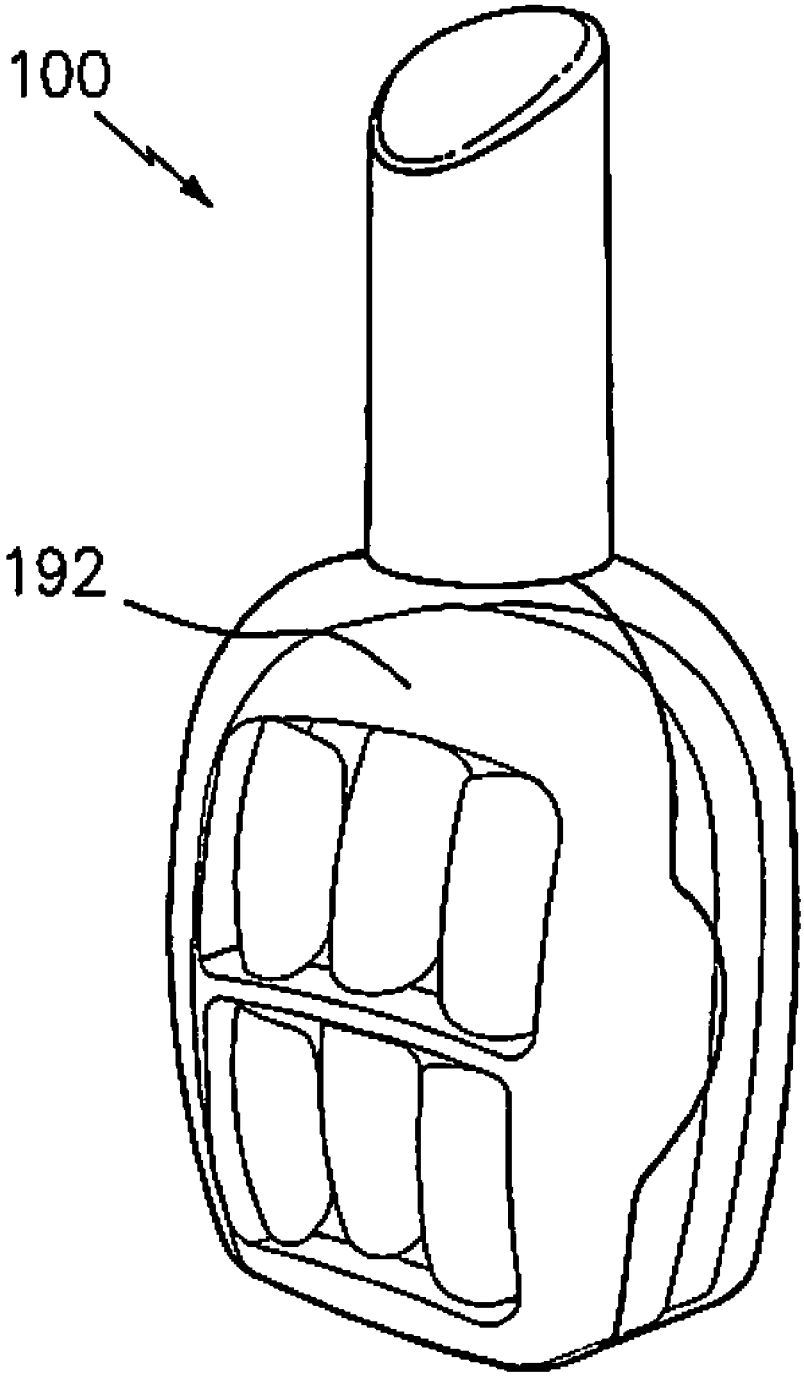

FIGS. 3(*a*) and 3(*b*) illustrate a front-view and a side-view of the display package;

FIG. 4 illustrates an exploded perspective view of the display package including a plurality of trays for supporting artificial nails, according to an embodiment of the present invention;

FIGS. 5(*a*) and 5(*b*) illustrate an assembled front-view and side-view including the plurality of trays;

FIG. 6 illustrates an exploded view of a tray case, according to a further embodiment of the present invention;

FIG. 7 illustrates the tray case assembly;

FIG. 8 illustrates the tray case within the display package.

DETAILED DESCRIPTION OF EMBODIMENTS OF THE PRESENT INVENTION

Embodiments of the present invention are described in detail with reference to the accompanying drawings. The same or similar components may be designated by the same or similar reference numerals although they are illustrated in different drawings. Detailed descriptions of constructions or processes known in the art may be omitted to avoid obscuring the subject matter of the present invention.

The terms and words used in the following description and claims are not limited to their dictionary meanings, but are merely used to enable a clear and consistent understanding of the invention. Accordingly, it should be apparent to those skilled in the art that the following description of embodiments of the present invention are provided for illustrative purposes only and not for the purpose of limiting the invention, as defined by the appended claims and their equivalents.

Figure 1:
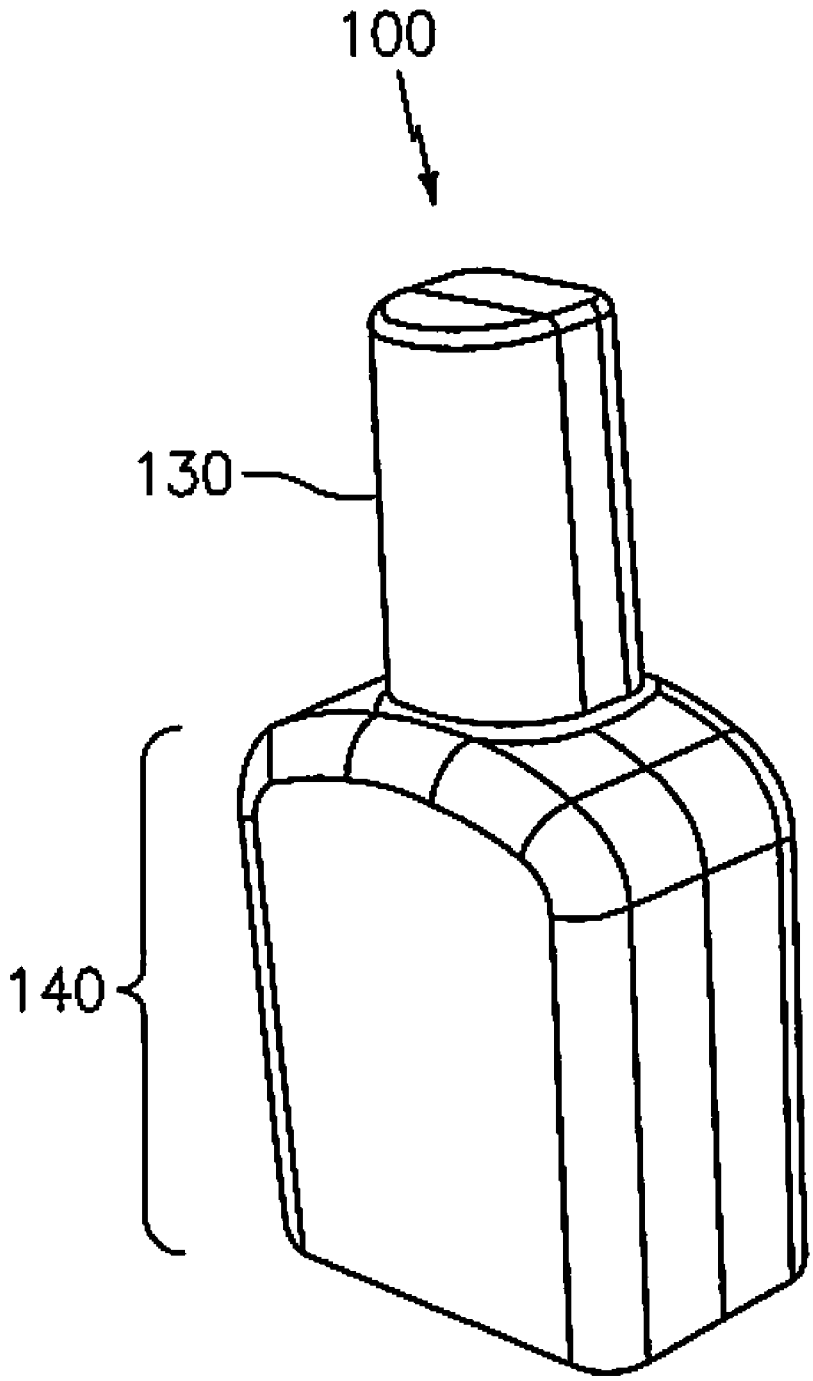
FIG. 1 illustrates a perspective view of a display package for artificial nails, according to an embodiment of the present invention.
Figure 2:
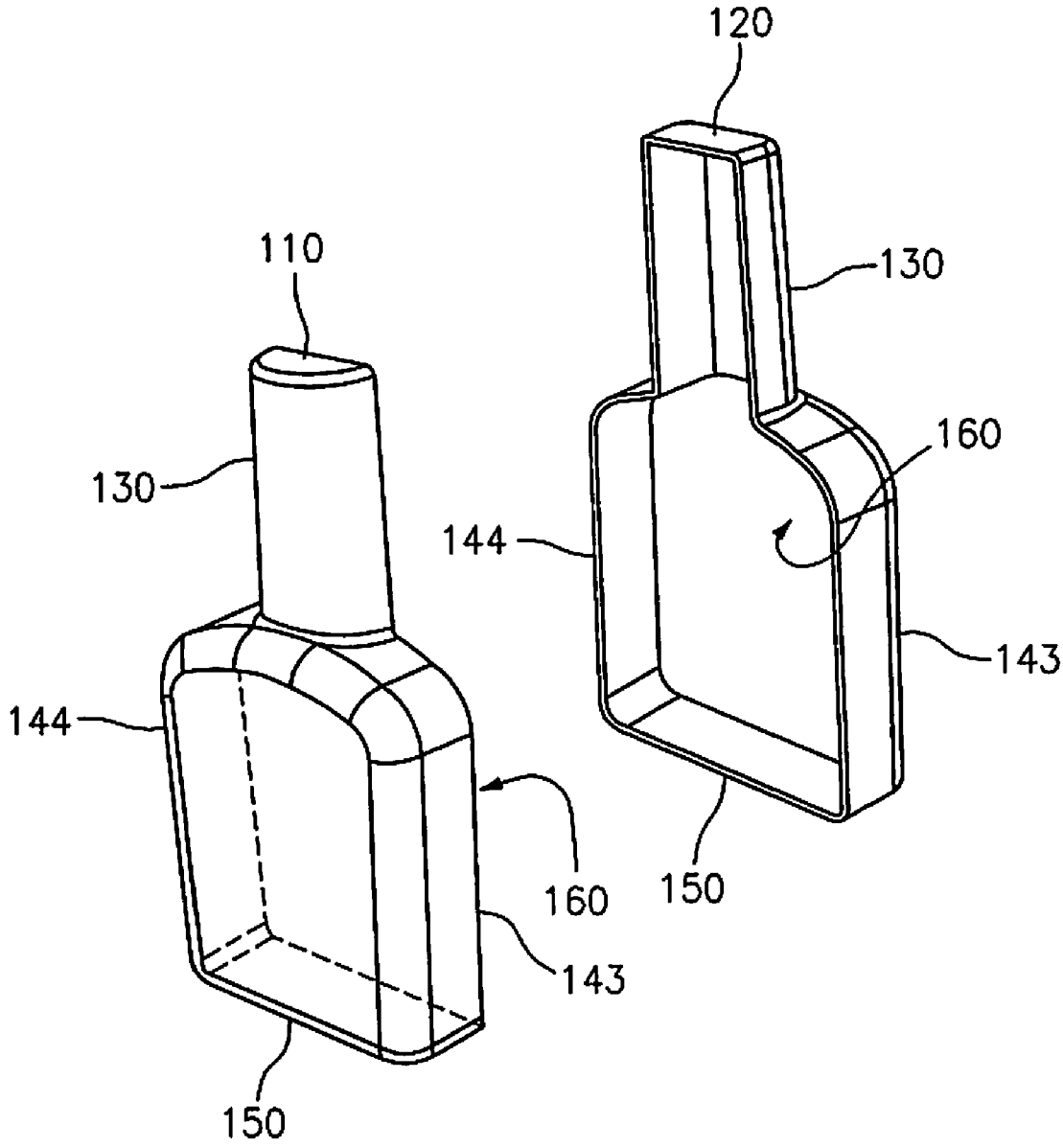
FIG. 2 illustrates an exploded view of the display package.

FIGS. 1 and 2 illustrate a display package 100, according to an embodiment of the present invention. The display package 100 includes a first portion 110 and a second portion 120, which, when attached, form the shape of a nail polish bottle. The display package is preferably a clear plastic made through a vacuum formed or injection-molded process. In the current embodiment, the first portion 110 and second portion 120, divide the display package 100 vertically in half. However, the display package 100 could be divided in many different ways, such as for example, horizontally. A cylindrical neck portion 130 extends from a main body 140. The main body 140 has a flat bottom portion 150 that allows the display package 100 to remain upright when placed on a flat surface. When the first portion 110 and the second portion 120 are brought together an empty cavity 160 is formed within the main body 140 of the display package 100.

FIG. 3 illustrates a front-view (a) and a side-view (b) of a display package 100, according to an embodiment of the present invention. In side-view 3(*b*), the first portion 110 and the second portion 120 are shown affixed together to form display package 100. The empty cavity 160 is formed within the main body 140 of the display package 100. The main body 140 includes a front wall 141, a back wall 142, and side-walls 143 and 144 that contour inwards to connect to the cylindrical neck portion 130 at one end of the display package 100 and meet at the top end opposite to the flat bottom portion 150.

FIG. 4 illustrates an exploded perspective view of the display package 100 including one or more trays 170, according to an embodiment of the present invention. The trays 170 can be made of various plastics by a vacuum formed or injection molded process. The trays 170 have a plurality of indentations 180 for holding items such as artificial nails. The plurality of indentations 180 can be aligned in a grid pattern or various other patterns and are shaped such that when a first tray 171 is stacked on a second tray 172, the first 171 and the second tray 172 may join in an interlocking manner.

As shown in FIG. 5, when the first portion 110 and the second portion 120 are joined together to form display package 100, the trays 170 are located within the empty cavity 160 of the display package 100. The first portion 110 and the second portion 120 may join by a snap fit, interlocking tabs or any other manner known by those of ordinary skill in the art. The trays 170 preferably have a similar shape as the main body 140 to prevent the trays 170 from moving within the empty cavity 160.

FIG. 6 illustrates a further embodiment of the invention having a cover tray 190 including indentations 200 for holding items such as artificial nails. The cover tray 190 fits over a bottom tray 191 to form a tray case 192, shown in FIG. 7. The tray case 192 fits within the empty cavity 160 (not shown) of display package 100, as illustrated in FIG. 8. When the cover tray 190 and bottom tray 191 are attached, a hollow space 210 is created for holding items such as artificial nails. Indentations 200 hold items such as artificial nails in an upright and organized position, whereas hollow space 210 holds items such as artificial nails in a loose manner.

While the invention has been shown and described with reference to certain embodiments thereof, it will be understood by those skilled in the art that various changes in form and detail may be made therein without departing from the spirit and scope of the invention as defined by the appended claims and their equivalents.

What is claimed is:

1. A display package comprising:

a cylindrical neck portion at a first end;

a main body having a front wall, a back wall, and side walls that contour inwards to connect to the cylindrical neck portion, the main body having a flat base at a second end opposite to the cylindrical neck portion;

the front wall, the back wall and the sidewalls of the main body forming a cavity there within; and a plurality of trays located within the cavity for holding items;

wherein the plurality of trays comprise a cover tray and a bottom tray, which together form a tray case, the tray case comprises a hollow interior space, and the cover tray comprises a plurality of open indentations for receiving the items on an exterior of the tray case, wherein the main body is separable into a first portion and a second portion to divide the main body and the cylindrical neck portion to allow placement of the plurality of trays in the cavity, and are joined together to form the display package.

2. The display package of claim 1, wherein when the first portion of the main body is joined to the second portion of the main body, the display package is in the shape of a nail polish bottle.

3. The display package of claim 1, wherein the items include artificial nails.

4. The display package of claim 1, wherein the plurality of trays are substantially the same shape as the main body.

5. The display package of claim 1, wherein the display package is formed from a clear plastic.

6. An apparatus for packaging and displaying artificial nails comprising:

a package body having a first half and a second half, the first half being symmetrical to the second half;

an internal cavity being formed within the package body when the first half is connected to the second half; and a plurality of trays located within the cavity for holding a plurality of artificial nails, wherein the package body comprises a cylindrical neck portion at a first end, a front wall, a back wall, and side walls that contour inwards to connect to the cylindrical neck portion, and a flat base at an end opposite to the cylindrical neck portion, wherein the plurality of trays comprise a cover tray and a bottom tray, which together form a tray case, the tray case comprises a hollow interior space, and the cover tray comprises a plurality of open indentations for receiving the items on an exterior of the tray case.

7. The apparatus of claim 6, wherein when the first half of the package body is joined to the second half of the package body, the package body is in the shape of a nail polish bottle.

* * * * *